United States Patent [19]

Kito

[11] Patent Number: 4,715,194

[45] Date of Patent: Dec. 29, 1987

[54] ICE MAKING MACHINE WITH WATER DISTRIBUTOR

[75] Inventor: Yoshikazu Kito, Toyoake, Japan

[73] Assignee: Hoshizaki Electric Co., Ltd., Toyoake, Japan

[21] Appl. No.: 922,169

[22] Filed: Oct. 23, 1986

[51] Int. Cl.[4] ..... F25C 1/12

[52] U.S. Cl. ..... 62/347; 239/559

[58] Field of Search ..... 62/347, 348, 352, 320, 62/74; 239/556, 558, 559

[56] References Cited

U.S. PATENT DOCUMENTS

| | | | |
|---|---|---|---|
| 2,682,155 | 6/1954 | Ayres et al. | 62/352 X |
| 2,826,045 | 3/1958 | Poffenberger | 62/347 X |
| 3,164,972 | 1/1965 | Swanson | 62/320 |
| 3,625,023 | 12/1971 | Swanson et al. | 62/348 X |

*Primary Examiner*—William E. Tapolcai

*Attorney, Agent, or Firm*—Wenderoth, Lind & Ponack

[57] ABSTRACT

An ice making machine includes a freezing plate having one surface placed in contact with an evaporator and the other surface serving as a freezing surface, and a water distributor for spraying water over the freezing surface. The water distributor comprises a pipe having a number of spaced orifices formed along the longitudinal direction of the pipe. Water is sprayed over the freezing surface. A dry zone or zone on which no water is sprayed is formed on the freezing surface at a location corresponding in position to the region of the one surface provided with the evaporator. Formation of ice starts from the boundary defining the dry zone, as the dry zone is inherently colder than the area on which water is sprayed, and a solid ice nucleus for propagating ice is formed therein, and proceeds to an ice slab over the whole freezing surface except the dry zone.

8 Claims, 7 Drawing Figures

ICE MAKING MACHINE WITH WATER DISTRIBUTOR

BACKGROUND OF THE INVENTION

1. Field of the Invention

The present invention relates to an ice making machine having a function or capability for preventing formation of imperfect ice such as so-called mush ice, slush ice or the like.

2. Description of the Prior Art

In a hitherto known ice making machine of the type in which water is recirculated over a surface of a freezing plate, as is illustrated in FIGS. 1 and 2 of the accompanying drawings, an evaporator 1*a* is provided on a rear surface of the freezing plate 1, and a water distributor 2 comprising a pipe of a circular section is disposed in the vicinity of and above the top end of the freezing plate 1, wherein water to be iced (hereinafter also referred to as ice making water) is sprayed over the freezing surface 1*b* of the freezing plate 1 from a number of orifices 2*a* formed in the lower peripheral portion of the water distributing pipe 2 in a linear array along the longitudinal direction thereof. With this arrangement, it is intended that the ice making water discharged from the individual orifices 2*a* of the water distributor 2 be distributed substantially uniformly over the whole freezing surface 1*b*, thus keeping temperature distribution gradients in the water flowing down over the freezing surface 1*b* to a possible minimum.

However, it has been observed that immediately before formation of ice on the freezing surface 1*b* of the freezing plate 1, so-called mush ice or slush ice which differs from a normal transparent ice slab in respect to various properties is likely to be produced on the freezing plate surface, as is discussed in detail in Japanese Laid-Open Patent Publication No. 96881/1980. When such mush ice or slush ice is formed, there arises a possibility that some of the orifices 2*a* of the water distributor 2 may be jammed by mush ice or slush ice, providing a great obstacle to forming a uniform ice slab over the freezing plate surface 1*b*. Consequently, ice pieces or ice cubes obtained from the cutting of the formed ice slab are degraded in geometrical configuration as well as ice quality.

Such being the circumstances, various approaches have been taken to prevent formation of mush ice or slush ice. For example, Japanese Laid-Open Patent Publication No. 53668/1980 discloses an arrangement in which a part of the ice making water before it is discharged over the freezing plate is supplied to the unfrozen ice making water leaving the freezing plate which may contain mush ice in order to eliminate such mush ice. However, this arrangement provides no fundamental solution to the problem mentioned above, because the formation of mush ice itself is not prevented. For this reason, the invention disclosed in the afore-mentioned Japanese Laid-Open Patent Publication No. 96881/1980 starts from the recognition that significant changes take place in various factors such as, for example, the temperature of the ice forming water, refrigerant and the like immediately before the mush ice is produced in the course of the freezing process and teaches that the amount of circulated water be decreased during a predetermined time interval by controlling the operation of a water circulating pump in response to output signals produced by sensor means such as thermostats, timers and the like which are designed to detect variations in such variable factors as mentioned above, to thereby form a nucleus of ice on the freezing plate surface so that an ice slab is formed over the whole freezing plate surface through an ice growing process starting from the ice nucleus. According to this procedure, formation of mush ice can be positively prevented, whereby the aimed object of this preceding invention is accomplished. Although the approach mentioned just above has an advantage over the first mentioned one in that formation of mush ice is thoroughly prevented, it still suffers drawbacks in that various elements are required for controlling the operation of the water circulation pump in addition to those for detecting the variations in the variable factors, involving high manufacturing costs for its embodiment.

SUMMARY OF THE INVENTION

Accordingly, an object of the present invention is to provide a water-circulation type ice making machine which is capable of preventing mush ice from being formed without the need for providing the ice making machine with any special additional elements.

In view of the above object, an ice making machine made in accordance with the teaching of the present invention includes a freezing (ice-making or icing) plate having one surface placed in contact with an evaporator and the other surface serving as a freezing surface, a compressor for supplying a refrigerant through the evaporator, and a distributor disposed in the vicinity of the top end of the freezing plate for spraying water over the freezing surface of the freezing plate. The distributor includes means for forming a dry zone at a predetermined region on the freezing surface, the region corresponding in position to that of one surface of the freezing plate where the evaporator is disposed.

More specifically, the water distributor comprises a pipe of a circular cross section having a number of spaced orifices arranged in the longitudinal direction, from which water is discharged over the freezing surface. A dry zone is formed on the ice freezing surface by diverting the water stream discharged from a particular orifice positioned upstream of the dry zone so that the latter is prevented from being sprayed with water. In other words, in a preferred embodiment of the invention, the direction of flow of the ice making water discharged from the particular orifice differs from that of the water streams discharged from all the other orifices and is directed toward a region located downstream of the dry zone. By providing the dry or non-sprayed zone, the water present on and along the boundary portion defining the dry zone is first refrigerated to a relatively low temperature to freeze and form an ice nucleus. In this way, occurrence of mush ice or slush ice is prevented. In another embodiment of the present invention, the water streams from all the orifices are directed to a region located downstream of the dry zone with respect to the direction of flow of the ice-making water.

BRIEF DESCRIPTION OF THE DRAWINGS

For a better understanding of the invention, reference may be made to the preferred embodiments, exemplary of the invention, shown in the accompanying drawings, in which.

DESCRIPTION OF THE PREFERRED EMBODIMENTS

Figure 3:
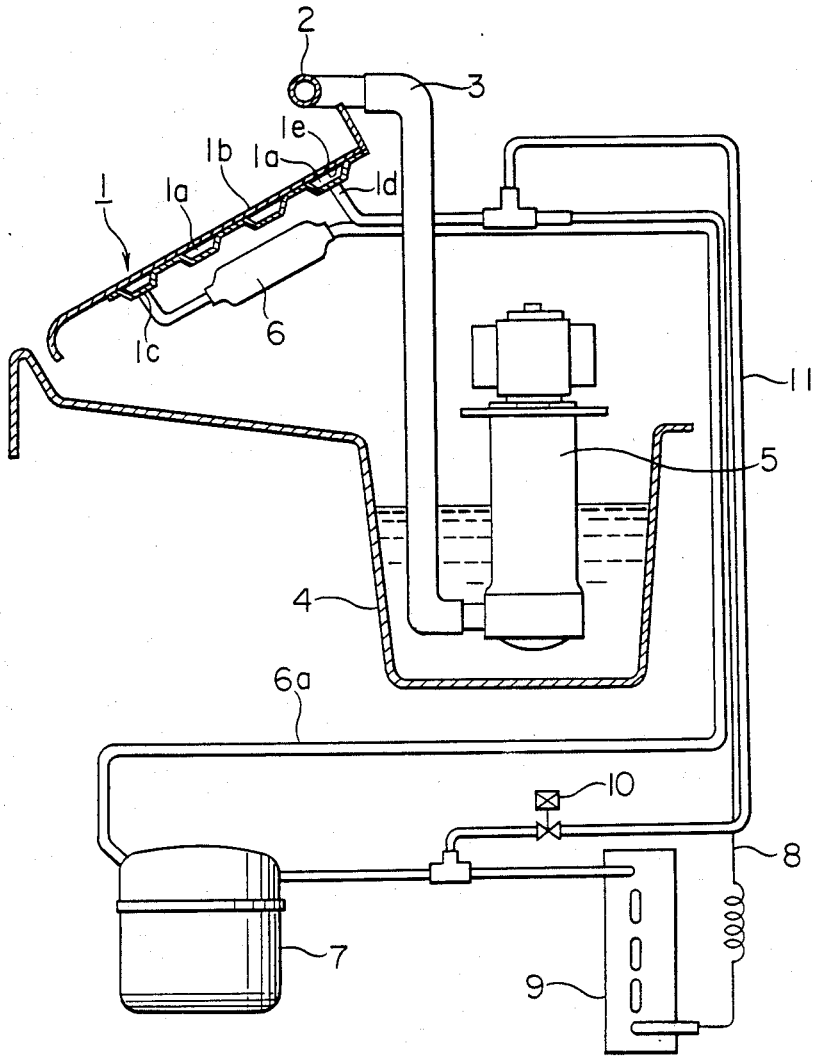
FIG. 3 is a schematic view showing an overall structure of an ice making machine in which the present invention is incorporated.

Referring now to the drawings, and more particularly to FIG. 3, an inclined ice making or freezing plate having a lower or rear surface provided with an evaporator 1*a* and an upper freezing surface 1*b* is generally designated by reference numeral 1. Disposed in the vicinity of the top of the freezing plate 2 is a tubular water sprayer or distributor 2 which extends horizontally in the widthwise direction of the freezing plate 1 in spaced relation with the freezing surface 1*b*. The water distributor 2 is connected through a water feed pipe 3 to a circulation pump 5 disposed within an ice making water supply tank 4.

The evaporator 1*a* has one end 1*c* connected to an inlet port of a compressor 7 by way of an accumulator 6 and a pipe 6*a*, while the other end 1*d* of the evaporator is connected to an outlet port of the compressor 7 by way of a capillary 8 and a condenser 9. A hot gas valve 10 is installed in a pipe 11 which bypasses the capillary 8 and the condenser 9. As is known in the art, the evaporator 1*a* is a pipe comprising a plurality of refrigerant passages (denoted by 1*a*', 1*a*'', 1*a*'''. . . in FIG. 5) interconnected by bent portions or bends (not shown) so that the pipe extends in a serpentine fashion from one end 1*c* of the evaporator 1*a* to the other end 1*d* thereof. There is therefore a region where the lower surface of the freezing plate 1 is in contact with the evaporator 1*a*.

Figure 4:
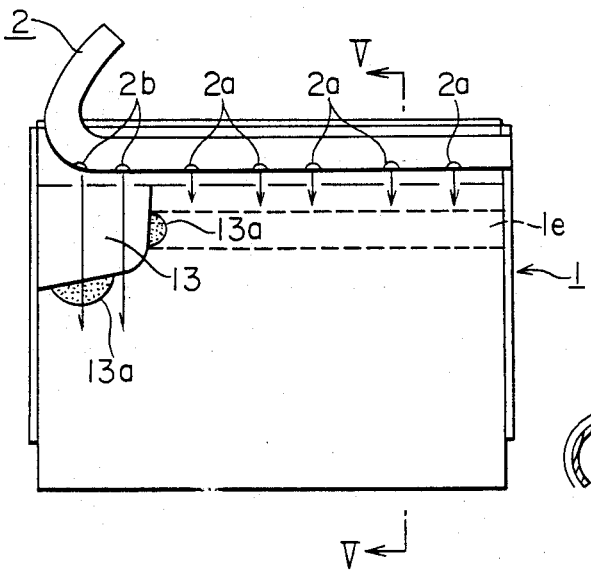
FIG. 4 is a plan view showing a freezing plate and a water distributor employed in the ice making machine shown in FIG. 3.
Figure 5:
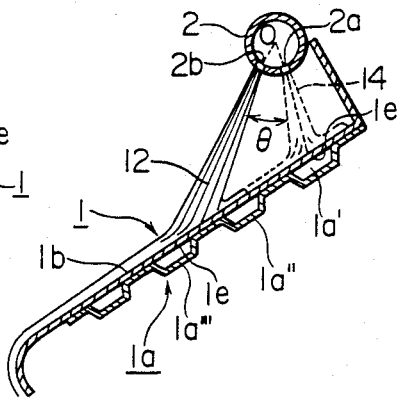
FIG. 5 is a view showing a section taken along the line V—V in FIG. 4.

Referring to FIGS. 4 and 5, the water distributor 4 is provided with a number of water spraying holes or orifices 2*a* and 2*b* distributed in the longitudinal direction thereof. Among these orifices 2*a* and 2*b*, one orifice 2*b* or a plurality of successive orifices 2*b* (in the case of the illustrated embodiment, two orifices 2*b*) formed in the end portion and the remaining orifices 2*a* are formed at different angular positions in the circumferential direction of the water distributor 2. More specifically, as is best seen in FIG. 5, the orifice 2*a* is bored at such an angular position that water from that orifice 2*a* flows toward an uppermost region 1*e* of the freezing surface 1*b* of the freezing plate 1 (i.e. the region associated with the uppermost refrigerant passage section 1*a*'of the evaporator 1*a*), while the orifices 2*b* are formed at such angular position that water steams discharged therefrom are angularly displaced from the water streams sprayed from the orifices 2*a* by a predetermined angle $\theta$ about the center axis 0 of the water distributor pipe 2.

With the arrangement of the orifices 2*a* and 2*b* mentioned above, the ice making water 12 discharged from the orifices 2*b* is sprayed over areas of the freezing surface 1*b* which generally correspond to the second and third refrigerant passage sections 1*a*'' and 1*a*''' of the evaporator 1*a* by skipping over or clearing the area associatd with the first refrigerant passage section 1*a*' corresponding to the refrigerant entry portion, as is illustrated in FIG. 5 by solid lines. In this manner, a non-sprayed area or dry zone 13 where no water 12 is sprayed is formed at an end portion (left end portion as viewed in FIG. 4) of the freezing surface 1*b* in a horizontally extending belt-like region 1*e* thereof which is associated with the refrigerant passage section 1*a*' constituting an entry section of the refrigerant, as is best seen in FIG. 4.

As described above, the other orifices 2*a* are oriented toward the region 1*e* of the freezing surface 1*b*, as in the case of prior art ice making machines, exclusive of the non-sprayed zone (i.e. dry zone or area) 13. Thus, the ice making water 14 from the orifices 2*a* is sprayed over the region associated with thr refrigerant passage section 1*a*', which means that water is sprayed over the whole ice making surface 1*b* expect for the non-sprayed zone 13.

In operation, the compressor 7 is first operated to supply the refrigerant through the evaporator 1*a* mounted on the rear surface of the freezing plate 1 to thereby cool the freezing surface 1*b* thereof, and at the same time, the circulation pump 5 is actuated to cause the ice making water to be sprayed over the freezing surface 1*b* from the individual orifices 2*a* and 2*b* of the water distributor 2. As the non-sprayed zone 13 located at the position corresponding to the inlet or entrance portion for the refrigerant is not sprayed with water, heat exchange with ice making water can not take place in this non-sprayed dry zone 13. Accordingly, temperature of the non-sprayed zone 13 is lower by several degrees when compared with that of the other region sprayed with water, resulting in growth of a solid ice nucleus 13*a* rather than mush ice at the boundary of the non-sprayed zone 13 in the region 1*e* associated with the first refrigerant passage section 1*a*'. When the ice making process further proceeds, freezing spreads over the whole ice making surface 1*b* starting from the nucleus ice 13*a* as a base, whereby an ice slab having a predetermined thickness and good quality is formed after lapse of a predetermined time. This state is detected by a known detector and in response to this detection signal, the freezing cycle is terminated while a defrosting or deicing cycle is initiated. To this end, the hot gas valve 10 is opened, a hot gas flows through the evaporator 1*a*, whereby the freezing surface 1*b* is heated, resulting in the ice slab being separated and released from the freezing plate. The ice slab thus released slides down over and along the freezing surface to be fed onto an ice cutting grid (not shown) where the ice slab is cut into a number of ice cubes or pieces by means of two sets of resistance wires constituting the grid, the resulting ice cubes or pieces being stored in an ice stocker (not shown).

Figure 1:
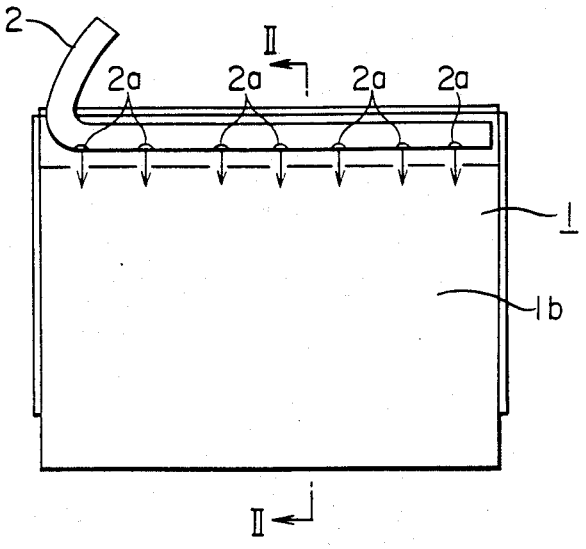
FIG. 1 PRIOR ART
FIG. 1 is a plan view showing a freezing plate and a water distributor employed in a conventional ice making machine.
Figure 2:
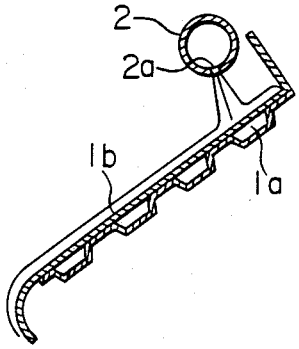
FIG. 2 PRIOR ART
FIG. 2 is a view showing a section taken along the line II—II in FIG. 1.
Figure 6:
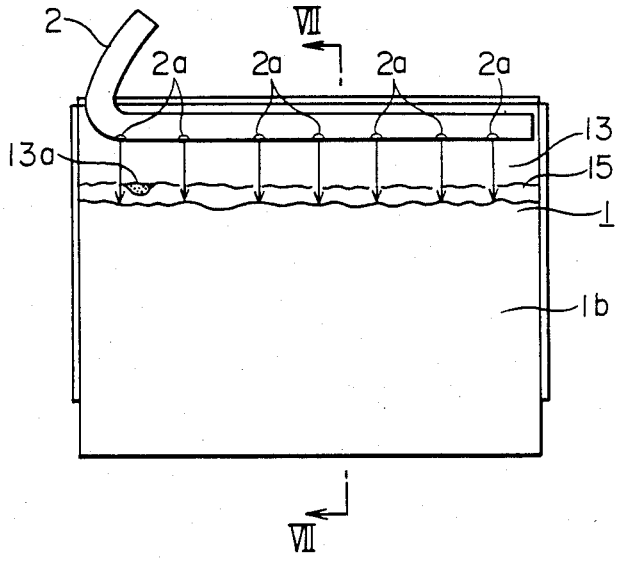
FIG. 6 is a plan view showing a freezing plate and a water distributor according to another embodiment of the present invention.
Figure 7:
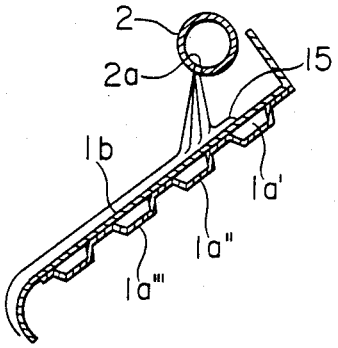
FIG. 7 is a view showing a section taken along the line VII—VII in FIG. 6.

FIGS. 6 and 7 show another embodiment of the present invention. Water discharged from all the orifices 2*a* is sprayed over the freezing surface 1*b* corresponding to the second and third refrigerant passage sections 1*a*'' and 1*a*''' while skipping the unnumbered area corresponding to area 1*e* of FIGS. 1 and 5 associated with the first refrigerant passage section 1*a*', whereby the ice making water 15 rising up under the capillary action, etc. is brought into contact the region 1*e* of the freezing surface corresponding to the refrigerant passage section 1*a*', i.e. the non-sprayed area 13.

With the structure described above, a rigid ice nucleus 13*a* without mush ice is formed in the non-sprayed dry area or zone 13.

In the foregoing, the present invention has been described in conjunction with an ice making machine of the type in which ice making water flows down along the upper surface of the inclined freezing plate. However, it goes without saying that the present invention can be equally applied to ice making machines of the type in which water flows down along the lower surface of the freezing plate or in which water flows along a vertical plane. Further, in the foregoing description, it has been assumed that all the orifices are provided in one and the same water distribution tube. It should however, be appreciated that the present invention is not restricted to the embodiments disclosed herein, but various modifications will readily occur to those skilled in the art. By way of example, the orifice(s) for defining the non-sprayed area may be provided in another water distributor. Alternately, one end of a water feed conduit may be connected to the water distribution tube so as to surround the orifice for the non-sprayed area while the other end thereof, from which water is discharged, may be extended to a position located beyond the non-sprayed area to prohibit the discharged water from being sprayed over the non-sprayed area. In another modification, a water receiving trough may be disposed below the orifice concerned with a distance spaced therefrom and extended to a position located beyond the non-sprayed area. This modification can be easily applied to existing ice making machines because only the provision of the trough is required.

It will be apparent that many modifications and variations are possible in light of the above teachings. It therefore is to be understood that within the scope of the appended claims, the invention may be practiced other than as specifically described.

What I claim is:

1. An ice making machine repeating an ice making cycle and a deicing cycle during operation thereof, comprising:

a freezing plate having one surface placed in contact with an evaporator and the other surface serving as a freezing surface;

a compressor in fluid communication with said evaporator for supplying a refrigerant thereto;

means disposed in the vicinity of one end of said freezing plate for distributing water over said freezing surface of said freezing plate during the ice making cycle; and said water distributing means including means operative during the ice making cycle for leaving a predetermined region of said freezing surface a dry zone in which no water is distributed on said freezing surface, said predetermined region corresponding in position to a portion of the region of said freezing plate where said evaporator is disposed, whereby the dry zone in which no water is distributed and which is in a region adjacent the evaporator is inherently somewhat colder than the region on which water is distributed, thereby ensuring the formation of a solid ice nucleus for propagation of ice to be made.

2. The ice making machine according to claim 1, wherein said freezing plate is disposed at an inclination with the freezing surface thereof facing upwardly.

3. The ice making machine according to claim 2, wherein said evaporator includes a plurality of refrigerant passage sections of substantially linear shape extending transversally in a direction widthwise of said freezing plate and spaced from one another in the direction of a water stream on said freezing surface, and bend sections for interconnecting the ends of said refrigerant passage sections so as to form a serpentine refrigerant flow path, said predetermined region of said freezing surface lying at a position corresponding to a region of said one surface of said freezing plate where the uppermost one of said plurality of refrigerant passage sections contacts with said freezing plate.

4. The ice making machine according to claim 3, wherein said water distributing means comprises a pipe having a number of orifices arranged in the longitudinal direction, said orifices being directed for causing water to be sprayed over said freezing surface to flow downwardly along said freezing surface.

5. The ice making machine according to claim 4, wherein at least one predetermined orifice of said number of orifices located at a position upstream of said dry zone with respect to the flow direction of the water stream is directed for causing water to be sprayed on said freezing surface so that the water is sprayed to clear said dry zone.

6. The ice making machine according to claim 5, wherein said at least one orifice is directed for causing water to be sprayed so that the water which clears said dry zone falls on a region of said freezing surface located at a position corresponding to the second one of said refrigerant passage sections.

7. The ice making machine according to claim 4, wherein all of said orifices are directed for causing water to be sprayed on said freezing surface so that the water is sprayed to clear said dry zone.

8. The ice making machine of claim 3, wherein an expansion valve is in fluid communication with said compressor and with said uppermost one of said plurality of refrigerant passage sections, whereby said dry zone at said predetermined region of said freezing plate is adjacent the substantially coldest passage section of said plurality of refrigerant passage sections.

* * * * *